US008081298B1

(12) United States Patent
Cross

(10) Patent No.: US 8,081,298 B1
(45) Date of Patent: Dec. 20, 2011

(54) HANDHELD RANGEFINDER OPERABLE TO DETERMINE HOLD-OVER BALLISTIC INFORMATION

(75) Inventor: John W. Cross, Overland Park, KS (US)

(73) Assignee: Bushnell, Inc., Overland Park, KS (US)

( * ) Notice: Subject to any disclaimer, the term of this patent is extended or adjusted under 35 U.S.C. 154(b) by 783 days.

(21) Appl. No.: 12/179,087

(22) Filed: Jul. 24, 2008

(51) Int. Cl.
*G01C 3/08* (2006.01)

(52) U.S. Cl. ..... 356/4.01; 356/3.01; 356/5.01; 356/5.1

(58) Field of Classification Search ..... 356/3.01–28.5
See application file for complete search history.

(56) References Cited

U.S. PATENT DOCUMENTS

| | | | |
|---|---|---|---|
| 3,464,770 | A | 9/1969 | Schmidt |
| 3,563,151 | A | 2/1971 | Koeber |
| 3,584,559 | A | 6/1971 | Levin |
| 3,639,997 | A | 2/1972 | Koeber |
| 3,644,043 | A | 2/1972 | Jones et al. |
| 3,653,769 | A | 4/1972 | Albright |
| 3,679,307 | A | 7/1972 | Zoot et al. |
| 3,688,408 | A | 9/1972 | Smith et al. |
| 3,690,767 | A | 9/1972 | Missio et al. |
| 3,737,232 | A | 6/1973 | Milburn, Jr. |
| 3,754,828 | A | 8/1973 | Darvasi |
| 3,781,111 | A | 12/1973 | Fletcher et al. |
| 3,797,909 | A | 3/1974 | Hadzimahalis |
| 3,839,725 | A | 10/1974 | Koppensteiner |
| 3,845,276 | A | 10/1974 | Kendy et al. |
| 3,847,474 | A | 11/1974 | Uterhart |
| 3,895,871 | A | 7/1975 | Strasser |
| 3,897,150 | A | 7/1975 | Bridges et al. |
| 3,899,251 | A | 8/1975 | Frenk et al. |
| 3,982,246 | A | 9/1976 | Lubar |
| 3,990,155 | A | 11/1976 | Akin, Jr. et al. |
| 3,992,615 | A | 11/1976 | Bennett et al. |
| 4,025,193 | A | 5/1977 | Pond et al. |
| 4,136,394 | A | 1/1979 | Jones et al. |
| 4,173,402 | A | 11/1979 | Horike et al. |
| 4,195,425 | A | 4/1980 | Leitz et al. |
| 4,266,463 | A | 5/1981 | Saltin |
| 4,268,167 | A | 5/1981 | Alderman |

(Continued)

OTHER PUBLICATIONS

McNeill, M.D. Williams, L. HuaMeng Chu "Design of a time-of-flight range-finder" Frontiers in Education Conference, 1999. FIE '99. 29th Annual, San Juan , Nov. 10-13, 1999, vol. 3, 13D6/17-13D6/22 vol. 3, ISBN: 0-7803-5643-8, DOI 10.1109/FIE.1999.840476.

(Continued)

*Primary Examiner* — Thomas Tarcza
*Assistant Examiner* — Luke Ratcliffe
(74) *Attorney, Agent, or Firm* — Hovey Williams LLP

(57) ABSTRACT

A handheld rangefinder device operable to determine ballistic hold-over information is disclosed. The rangefinder device generally includes a range sensor operable to determine a range to a target, a memory storing a database of ranges and corresponding hold-over values for a default sight-in distance, and a computing element, coupled with the range sensor and the memory. The computing element may calculate an adjusted hold-over value based on the range and an actual sight-in distance. Additionally, a tilt sensor may be included to provide information for calculating an angle-adjusted hold-over value. Such a configuration facilitates accurate fire-arm use by providing ranges and hold-over values without requiring time-consuming and manual user calculations.

22 Claims, 6 Drawing Sheets

U.S. PATENT DOCUMENTS 4,305,657 A 12/1981 Masunaga et al.
4,321,683 A 3/1982 Goring et al.
4,329,033 A 5/1982 Masunaga et al.
4,355,904 A 10/1982 Balasubramanian
4,457,621 A 7/1984 Harris et al.
4,531,052 A 7/1985 Moore
4,561,204 A 12/1985 Binion
4,593,967 A 6/1986 Haugen
4,617,741 A 10/1986 Bordeaux et al.
4,665,795 A 5/1987 Carbonneau et al.
4,681,433 A 7/1987 Aeschlimann
4,760,770 A 8/1988 Bagnall-Wild et al.
4,777,352 A 10/1988 Moore
4,787,739 A 11/1988 Gregory
4,834,531 A 5/1989 Ward
4,949,089 A 8/1990 Ruszkowski, Jr.
4,965,439 A 10/1990 Moore
4,988,189 A 1/1991 Kroupa et al.
5,022,751 A 6/1991 Howard
5,026,158 A 6/1991 Golubic
5,082,362 A 1/1992 Schneiter
5,216,815 A 6/1993 Bessacini
5,233,357 A 8/1993 Ingensand et al.
5,241,360 A 8/1993 Key et al.
5,262,838 A 11/1993 Tocher
5,280,332 A 1/1994 Tocher et al.
5,291,262 A 3/1994 Dunne
5,294,110 A 3/1994 Jenkins et al.
5,311,271 A 5/1994 Hurt et al.
5,313,409 A 5/1994 Wiklund et al.
5,359,404 A 10/1994 Dunne
5,374,985 A 12/1994 Beadles et al.
5,374,986 A 12/1994 Solinsky
5,375,072 A * 12/1994 Cohen ..... 702/94
5,479,712 A 1/1996 Hargrove et al.
5,483,336 A 1/1996 Tocher
5,519,642 A 5/1996 Kishimoto
5,539,513 A 7/1996 Dunne
5,568,152 A 10/1996 Janky et al.
5,586,063 A 12/1996 Hardin et al.
5,589,928 A 12/1996 Babbitt et al.
5,623,335 A 4/1997 Bamberger
5,634,278 A 6/1997 London
5,638,163 A 6/1997 Nourricier, Jr.
5,650,949 A 7/1997 Kishimoto
5,669,174 A 9/1997 Teetzel
5,677,760 A 10/1997 Mikami et al.
5,686,690 A 11/1997 Lougheed et al.
5,691,808 A 11/1997 Nourrcier, Jr. et al.
5,751,406 A 5/1998 Nakazawa et al.
5,806,020 A 9/1998 Zykan
5,812,893 A 9/1998 Hikita et al.
5,824,942 A 10/1998 Mladjan et al.
5,914,775 A 6/1999 Hargrove et al.
5,926,259 A 7/1999 Bamberger et al.
5,933,224 A 8/1999 Hines et al.
5,940,171 A 8/1999 Tocher
6,023,322 A 2/2000 Bamberger
6,034,764 A 3/2000 Carter
6,131,294 A 10/2000 Jibiki
6,252,706 B1 6/2001 Kaladgew
6,407,817 B1 6/2002 Norita et al.
6,634,112 B2 10/2003 Carr et al.
6,873,406 B1 3/2005 Hines et al.
6,886,287 B1 5/2005 Bell et al.
7,118,498 B2 10/2006 Meadows et al.
7,239,377 B2 7/2007 Vermillion et al.
2002/0107768 A1 8/2002 Davis et al.
2004/0020099 A1 2/2004 Osborn
2005/0021282 A1 1/2005 Sammut
2005/0046706 A1 3/2005 Sesek et al.
2005/0198885 A1 9/2005 Staley
2005/0221905 A1 10/2005 Dunne et al.
2006/0010760 A1 * 1/2006 Perkins et al. ..... 42/142
2007/0132982 A1 6/2007 Vermillion et al.
2007/0137088 A1 6/2007 Peters et al.
2007/0137091 A1 6/2007 Cross et al.
2007/0197314 A1 8/2007 York et al.
2007/0258082 A1 11/2007 Vermillion et al.

OTHER PUBLICATIONS

Pito, R., "Characterization, Calibration, and Use of the Perception Laser Range Finder in a Controlled Environment," (1995). http://scholar.google.com/scholar?num=50&hl=en&lr=&q=3D+laser+rangefinder+-patents &as_ylo=&as_yhi=1997 &btnG=Search.
Leica Geovid 7×42BD Laser Rangefinder Binoculars, eBay item 110227983724, Mar. 5, 2008.
NAIT XLR Range Finder, http://web.archive.org/web//19980119122437/nait.com/xlr.html, Jan. 19, 1998.
"Quantum Range Finding" by Bill Winke, Bowhunting, p. 49-53 & 97, Aug. 1995.
"A look at what's new in laser Rangefinders" by L.D. Standish, Precision Shooting, pp. 44-49, Nov. 1997.
Criterion Series Hand Held Survey Lasers (advertisement), No Date.
Hermet, P., "Design of a rangefinder for military purposes," Applied Optics. 11, 273- (1972).
Woodward, J, et al., "Rangefinder, laser AN/GVS-5," Jun. 1977.
Leica Vector Rangefinding Binoculars, http://web.petabox.bibalex.org/web/19970607010412/www.leica.com/optronics/product/vector.htm, Jun. 7, 1997.
VX Optranics Corp., Hawk Expeditor & Hawk XTR (2-page advertisement) No Date.
"Rifleman's rule" http://en.wikipedia.org/wiki/Rifleman's_rule, No Date.
"Inclined Fire" By William T. McDonald, Jun. 2003.

* cited by examiner

HANDHELD RANGEFINDER OPERABLE TO DETERMINE HOLD-OVER BALLISTIC INFORMATION

BACKGROUND

1. Field

The present invention relates to handheld rangefinders for assisting a user in compensating for variables that affect projectile trajectory. More particularly, the present invention relates to a handheld rangefinder that utilizes a range sensor and a computing element to adjust stored hold-over values corresponding to a given range to compensate for an actual sight-in distance differing from a default sight-in distance.

2. Related Art

Hunters and other firearm and bow users commonly use handheld rangefinders to determine ranges to targets. Utilizing the displayed ranges, the hunter makes sighting corrections to facilitate accurate shooting.

For example, a rifle may be "sighted-in" or set for a particular range, such that the bullet strikes the target when crosshairs of a rifle scope are aligned with the target. But at distances greater than the sight-in distance, the bullet will be low on the target. Therefore, to compensate for this, the shooter must raise the rifle by an angle called "hold-over". A rifle scope elevation adjustment assembly, such as described in U.S. Pat. No. 3,990,155 may be used to adjust the angle of the rifle by a specific hold-over value. Historically, handheld rangefinders fail to determine hold-over ballistic information corresponding to the amount by which hunters must vary their aim, thereby forcing hunters to manually perform hold-over calculations.

Additionally, slope and elevation may affect the projectile path of a bullet, such as when a hunter is positioned above or below a target. In such a situation, a bullet will hit the target higher than it would when the target is on the same elevation as the shooter.

Devices operable to compensate for slope and elevation utilizing lasers and inclinometers have been developed to alleviate some of these problems. Unfortunately, some of these devices have a limited field of vision, must be attached to a firearm, or are unable to provide hold-over ballistic information. Thus, hunters are unable to avail themselves of the beneficial aspects of handheld rangefinders, such as increased field of vision, maneuverability, and portability, while correcting for range, slope, elevation, and rangefinder orientation utilizing hold-over ballistic information.

Besides range, elevation, and slope, other variables can affect the hold-over value required for accurate aim, such as the particular projectile or firearm utilized as well as the distance at which a firearm is sighted-in. To determine the most accurate hold-over value, all of these variables should be considered. However, factoring all of these variable into manual hold-over calculations may not be practical or possible while hunting, since a target may not remain stationary for very long.

SUMMARY

The present invention solves the above-described problems and provides a distinct advance in the art of handheld rangefinders. More particularly, the invention provides a handheld rangefinder that includes a range sensor and a computing element to determine hold-over ballistic information corresponding to projectile trajectories. Such a configuration facilitates accurate firearm use by providing ranges and hold-over values without requiring time-consuming and manual user calculations.

In one embodiment, the device generally includes a range sensor for determining a range to a target, a memory element storing a database of ranges and corresponding hold-over values for a default sight-in distance, and a computing element, coupled with the range sensor and the memory, for receiving an actual sight-in distance and the range to the target. The actual sight-in distance may be provided to the computing element by a shooter. The computing element may be used to determine an adjusted hold-over value for the range to the target by accessing a first hold-over value from the database corresponding with the range to the target, accessing a second hold-over value from the database corresponding with a range equal to the actual sight-in distance, and subtracting the second hold-over value from the first hold-over value.

In another embodiment, the rangefinder device includes the range sensor, a tilt sensor for determining an angle to the target relative to the rangefinder device, the memory element, an input for providing the actual sight-in distance, and the computing element. The computing element may be coupled with the range sensor, the tilt sensor, the input, and the memory, for receiving the actual sight-in distance, the angle, and the range to the target. The computing device may also be used to determining the adjusted hold-over value for the range to the target by accessing the first hold-over value from the database, accessing the second hold-over value from the database, and subtracting the second hold-overvalue from the first hold-over value. Additionally, the computing element may compensate for shooting at an incline by calculating an angle-adjusted hold-over value based on the adjusted hold-over value and the angle. The rangefinder device may also include a display for indicating the range and the hold-over value.

In another embodiment, the present invention provides a method for determining hold-over ballistic information. The method generally comprises obtaining the range to a target and the actual sight-in distance, accessing the database of hold-over values, obtaining the first hold-over value from the database based on the range, obtaining the second hold-over value from the database based on the actual sight-in distance, and subtracting the second hold-over value from the first hold-over value to obtain an adjusted hold-over value.

Other aspects and advantages of the present invention will be apparent from the following detailed description of the preferred embodiments and the accompanying drawing figures.

BRIEF DESCRIPTION OF THE DRAWINGS

A preferred embodiment of the present invention is described in detail below with reference to the attached drawing figures, wherein.

Figure 1:
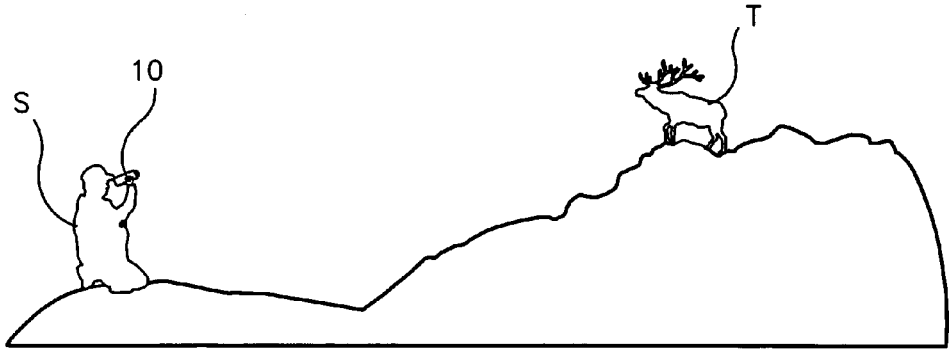
FIG. 1 is a schematic view showing a hunter aiming at a target on a different elevation with a rangefinder device configured in accordance with various preferred embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
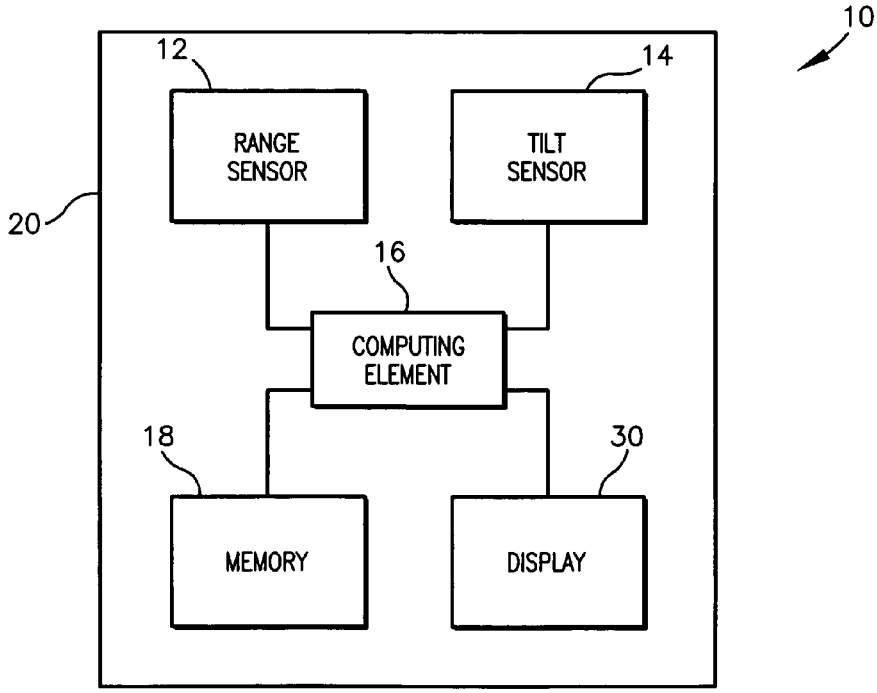
FIG. 2 is a block diagram of the rangefinder device.
Figure 3:
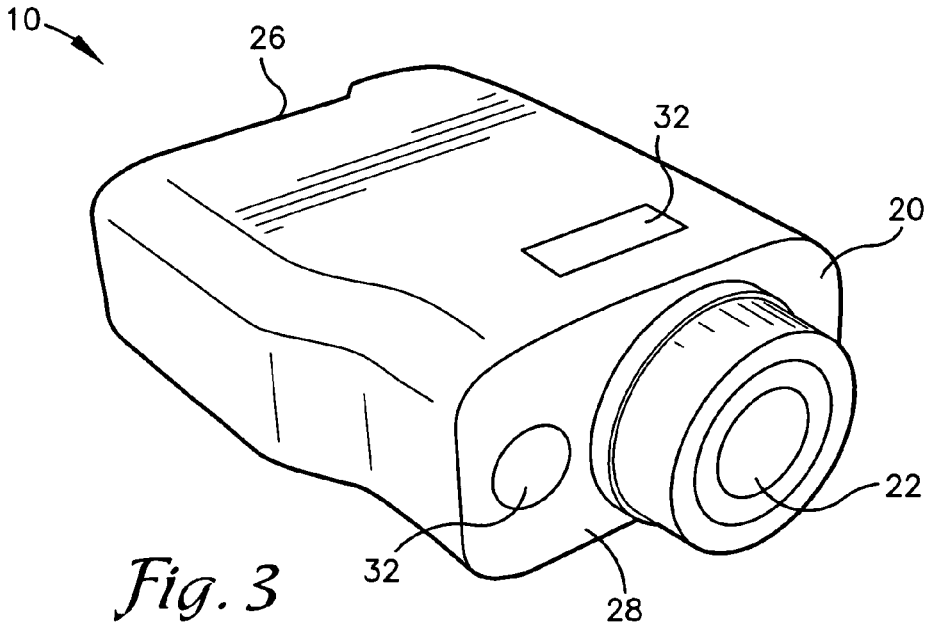
FIG. 3 is a rear perspective view of the rangefinder device of FIGS. 1-2.
Figure 4:
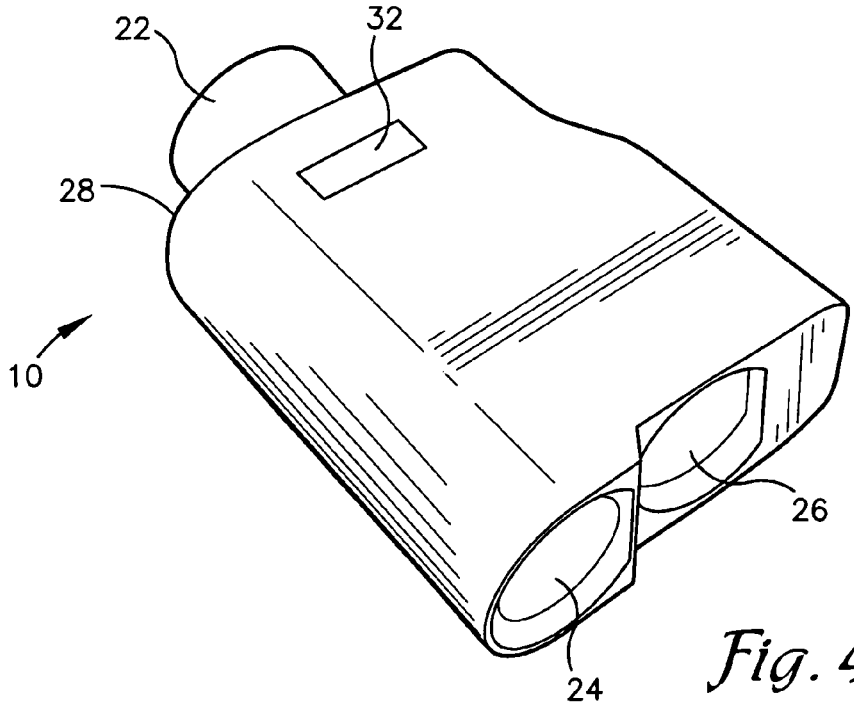
FIG. 4 is a front perspective view of the rangefinder device of FIGS. 1-3.

FIG. 1 illustrates a shooter taking aim at a target T with a rangefinder device 10, constructed in accordance with an embodiment of the present invention. The device 10 may be a small, portable, handheld device for use in determining a range to a target T, such as an animal, an angle to the target T, and ballistic information, such as a holdover value, so that the shooter S may apply the holdover value to a firearm. As illustrated in FIGS. 2-4, the device 10 generally includes a range sensor 12 for determining the range to the target T, a tilt sensor 14 for determining the angle to the target T, a computing element 16 coupled with the range sensor 12 and the tilt sensor 14 for determining ballistic information relating to the target T, a memory 18 for storing data such as ballistic information and a computer program to control the functionality of the device 10, and a portable handheld housing 20 for housing the range sensor 12, the tilt sensor 14, the computing element 16, the memory 18, and other components described below.

A computer program preferably controls input and operation of the device 10. The computer program includes at least one code segment stored in or on a computer-readable medium residing on or accessible by the device 10 for instructing the range sensor 12, tilt sensor 14, computing element 16, and any other related components to operate in the manner described herein. The computer program is preferably stored within the memory 18 and comprises an ordered listing of executable instructions for implementing logical functions in the device 10. However, the computer program may comprise programs and methods for implementing functions in the device 10 which are not an ordered listing, such as hard-wired electronic components, programmable logic such as field-programmable gate arrays (FPGAs), application specific integrated circuits, conventional methods for controlling the operation of electrical or other computing devices, etc.

Similarly, the computer program may be embodied in any computer-readable medium for use by or in connection with an instruction execution system, apparatus, or device, such as a computer-based system, processor-containing system, or other system that can fetch the instructions from the instruction execution system, apparatus, or device, and execute the instructions.

The device 10 and computer program described herein are merely examples of a device and a program that may be used to implement the present invention and may be replaced with other devices and programs without departing from the scope of the present invention.

Figure 5:
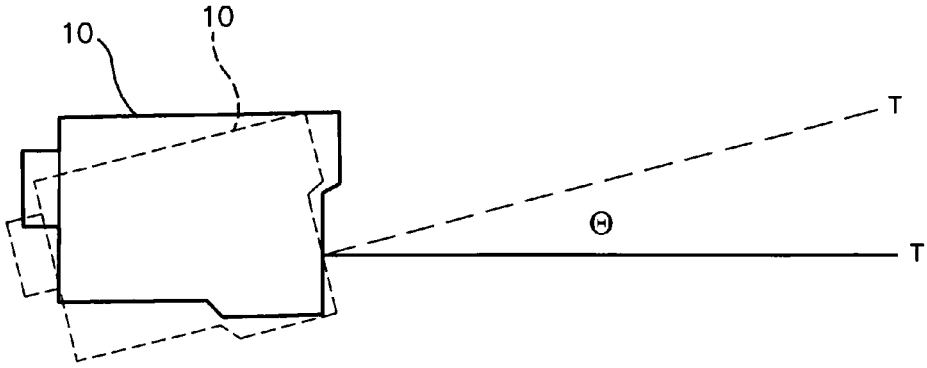
FIG. 5 is a diagram illustrating an angle to an elevated target relative to the device.

The range sensor 12 is operable to determine the range to the target T from the device 10. The range sensor 12 may be any conventional sensor or device for determining range. The range preferably represents a length of an imaginary line drawn between the device 10 and the target T, as shown in FIG. 5, such as the number of feet, meters, yards, miles, etc, directly between the device 10 and the target T. Thus, the range may correspond to a line of sight (LOS) between the device 10 and the target T.

Preferably, the range sensor 12 is a laser range sensor which determines the range to the target by directing a laser beam at the target T, detecting a reflection of the laser beam, measuring the time required for the laser beam to reach the target and return to the range sensor 12, and calculating the range of the target T from the range sensor 12 based on the measured time. Thus, the range sensor 12 may include an emitter and a detector to emit the laser beam and then detect the reflection of the laser beam in a generally conventional manner.

The range sensor 12 is operable to determine a range to a target even when objects, such as trees, people, vehicles, foliage, etc, are positioned between the device and the target. As a result, the range sensor 12 may determine the range to the target T in a variety of situations, including in outdoor situations where various trees and/or other foliage may obstruct a direct view of the target T.

The range sensor 12 may also include memory and processing capabilities separate from the computing element 16 and memory 18, such that the range sensor is operable to determine the range to the target T without the assistance of additional components. However, the range sensor 12 may rely upon the capabilities provided by the computing element 16 and memory 18 to specifically calculate and determine the range.

The range sensor 12 may alternatively or additionally include other range sensing components, such as conventional optical, radio, sonar, or visual range sensing devices to determine the range in a substantially conventional manner.

Figure 6:
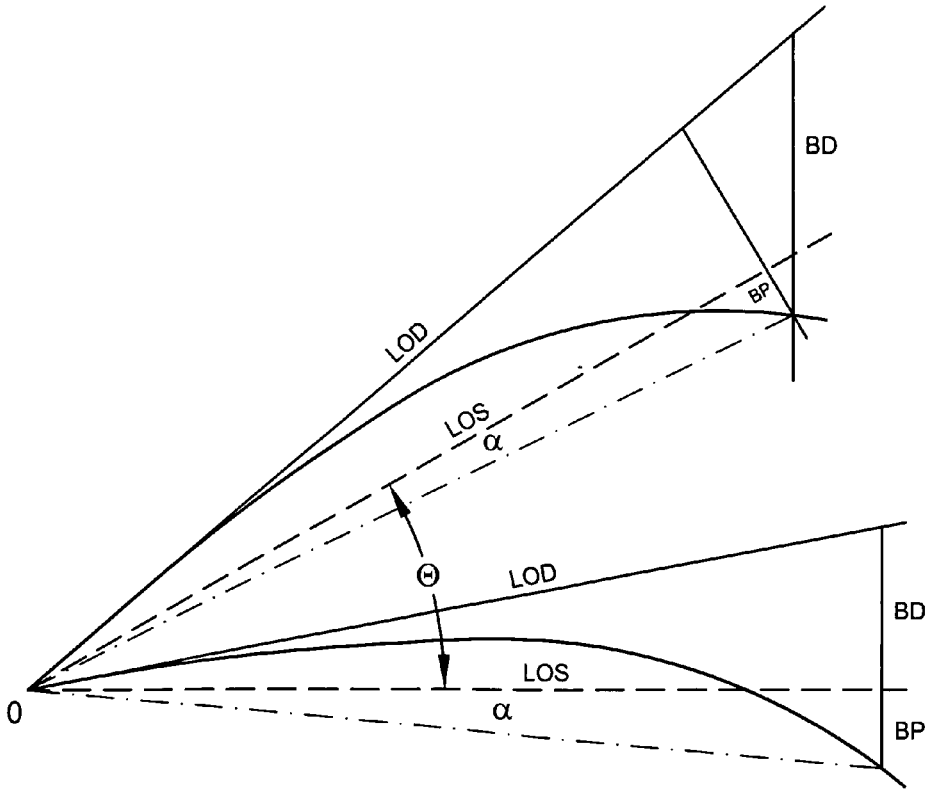
FIG. 6 is a diagram illustrating various angles and projectile trajectories relative to the device.

The tilt sensor 14 is operable to determine the angle to the target T from the device 10 relative to the horizontal. Thus, as shown in FIGS. 5, and 6, if the device 10 and the target T are both positioned on a flat surface having no slope, the angle would be zero. As shown in FIG. 6, if the device 10 is positioned below the target T the slope between the device 10 and the target T is positive, the angle would be positive. Conversely, if the device 10 is positioned above the target T, such that the slope between the device 10 and the target T is negative, the angle would be negative.

It will be appreciated that the angle is not dependent upon the specific contours of the ground, surface, or surfaces between the device 10 and the target T, but rather is dependant upon the difference in elevation of the shooter and the target. Therefore, the angle is preferably determined based on the orientation of the device 10, as described below.

The tilt sensor 14 preferably determines the angle by sensing the orientation of the device 10 relative to the target T and the horizontal. The orientation of the device 10 changes based on the relative position of the target T to the device 10, as a user of the device 10 aligns the device 10 with the target T and views the target T through an eyepiece 22 and an opposed lens 24, as described in more detail below. Thus, the orientation of the device 10, specifically the tilt of the device 10 along its longitudinal axis relative to the horizontal, indicates if the target T is above or below the device 10.

For example, if the target T is above the device 10, the user of the device 10 would tilt the device 10 such that a distal end 26 of the device 10 would be raised relative to a proximate end 28 of the device 10 and the horizontal. Similarly, if the target T is below the device 10, the user of the device 10 would tilt the device 10 such that the distal end 26 of the device 10 would be lowered relative to the proximate end 28 of the device and the horizontal.

The tilt sensor 14 preferably determines the angle of the target to the device 10 based on the amount of tilt, that is the amount the proximate end 28 is raised or lowered relative to the distal end 26, as described below. The tilt sensor 14 may determine the tilt of the device, and thus the angle, through various orientation determining elements. For instance, the tilt sensor 14 may utilize one or more single-axis or multiple-axis magnetic tilt sensors to detect the strength of a magnetic field around the device 10 or tilt sensor 14 and then determine the tilt of the device 10 and the angle accordingly. The tilt sensor 14 may determine the tilt of the device using other or additional conventional orientation determine elements, including mechanical, chemical, gyroscopic, and/or electronic elements, such as a resistive potentiometer.

The tilt sensor 14 may be an electronic inclinometer, such as a clinometer, operable to determine both the incline and decline of the device 10 such that the angle may be determined based on the amount of incline or decline. Thus, as the device 10 is aligned with the target T by the user, and the device 10 is tilted such that its proximate end 28 is higher or lower than its distal end 26, the tilt sensor 14 will detect the amount of tilt which is indicative of the angle.

The computing element 16 is coupled with the range sensor 12 and the tilt sensor 14 to determine ballistic information relating to the target T, including hold-over ballistic information, as is discussed in more detail below. The computing element 16 may be a microprocessor, microcontroller, or other electrical element or combination of elements, such as a single integrated circuit housed in a single package, multiple integrated circuits housed in single or multiple packages, or any other combination. Similarly, the computing element 16 may be any element which is operable to determine hold-over ballistic information from the range and angle as described below. Thus, the computing element 16 is not limited to conventional microprocessor or microcontroller elements and may include any element which is operable to perform the functions described below.

The memory 18 is coupled with the computing element 16 and is operable to store the computer program and a database including ranges, hold-over values, and configuration information, as is discussed in detail below. The memory 18 may be, for example, an electronic, magnetic, optical, electromagnetic, infrared, or semi-conductor system, apparatus, device, or propagation medium. More specific, although not inclusive, examples of the memory 18 include the following: volatile and non-volatile memory, an electrical connection having one or more wires, a portable computer diskette, a random access memory (RAM), a read-only memory (ROM), an erasable, programmable, read-only memory (EPROM or Flash memory), an optical fiber, a portable compact disc (CD), or a digital video disc (DVD). However, the memory 18 may be of any form operable to store the necessary computer program and data.

The memory 18 may be integral with the computing element 16, such that the memory 18 and the computing element 16 are stored within or on the same wafer, die, or package, or the memory 18 may be discrete with the computing element 16 such that the memory 18 and the computing element 16 are stored on different wafers, dies, or packages. Additionally, the memory 18 may be coupled with other components, such as the range sensor 12 and tilt sensor 14, to enable the other components to utilize the functionality provided by the memory 18. The memory 18 may also be accessible by other external devices, such as conventional computing devices, to enable data stored within the memory, such as the database or the computer program, to be easily accessed or modified by conventional computing devices.

Figure 8:
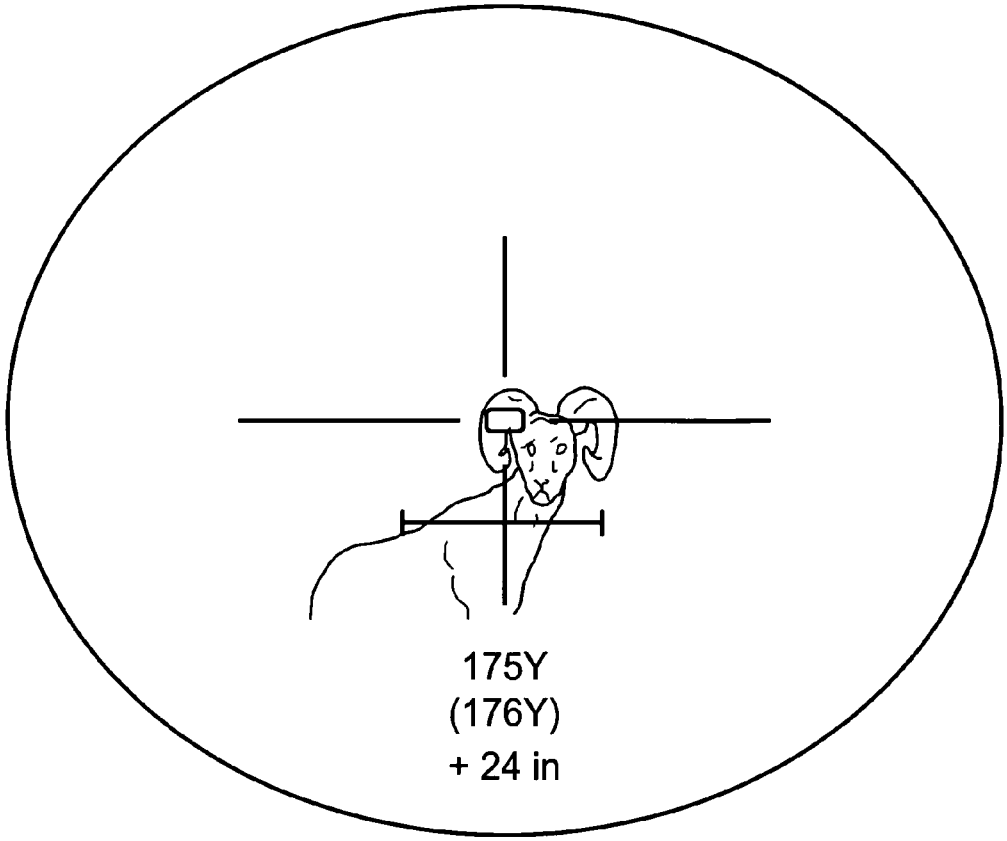
FIG. 8 is a schematic view of a target observed while looking through the device, a display indicating the range, the second range, and a hold-over value.

The device 10 also preferably includes a display 30 to indicate relevant information such as the target T, the range, the angle, and ballistic information such as hold-over information, a reticle or other alignment element, etc. The display 30 may be a conventional electronic display, such as a LED, TFT, or LCD display. Preferably, the display 30 is viewed by looking through the eyepiece 22 such that the user may align the target T and simultaneously view relevant information, as shown in FIG. 8.

For instance, the user may look through the eyepiece 22, align the target T, view the target T, and generally simultaneously view the display 30 to determine the range, the angle θ, hold-over value, and/or other relevant information. The generally simultaneous viewing of the target T and the relevant information enables the user to quickly and easily determine ranges and ballistic information corresponding to various targets by moving the device 10 in an appropriate direction and dynamically viewing the change in the relevant information on the display 30.

The portable handheld housing 20 houses the range sensor 12, tilt sensor 14, computing element 16, and/or other desired elements such as the display 30, one or more inputs 32, eyepiece 22, lens 24, laser emitter, laser detector, etc. The handheld housing 20 enables the device 10 be easily and safely transported and maneuvered for convenient use in a variety of locations.

For example, the portable handheld housing 20 may be easily transported in a backpack for use in the field. Additionally, the location of the components on or within the housing 20, such as the position of the eyepiece 22 on the proximate end 28 of the device 10, the position of the lens 24 on the distal end 26 of the device, and the location of the inputs 32, enables the device 10 to be easily and quickly operated by the user with one hand without a great expenditure of time or effort.

The inputs 32 are coupled with the computing element 16 to enable users, third parties, or other devices to share information with the device 10. The inputs 32 is generally associated with the housing 20, such as by physical connection through wires, etc, or wirelessly utilizing conventional wireless protocols. Thus, the inputs 32 need not be physically coupled with the housing 20. However, the inputs 32 are preferably positioned on the housing 20 to enable the user to simultaneously view the display 30 through the eyepiece 22 and function the inputs 32.

The inputs 32 preferably comprise one or more functionable inputs such as buttons, switches, scroll wheels, etc, a touch screen associated with the display 30, voice recognition elements, pointing devices such as mice, touchpads, trackballs, styluses, combinations thereof, etc. Further, the inputs 32 may comprise wired or wireless data transfer elements such as removable memory including the memory 18, network connections, data transceivers, etc, to enable the user and other devices or parties to remotely interface with the device 10. The inputs 32 may be used by the shooter to input an actual sight-in distance to the computing element 16 for calculation purposes, as described below.

In operation, the user aligns the device 10 with the target T and views the target T on the display 30. The device 10 may provide generally conventional optical functionality, such as magnification or other optical modification, by utilizing the lens 24 and/or the computing element 16. Preferably, the device 10 provides an increased field of vision as compared to conventional riflescopes to facilitate conventional rangefinding functionality.

Further, the user may function the inputs 32 to control the operation of the device 10. For example, the user may activate the device 10, provide configuration information and an actual sight-in distance as discussed below, and/or determine a range, angle, and ballistic information by functioning one or more of the inputs 32.

For instance, the user may align the target T by centering the reticle over the target T and functioning at least one of the inputs 32 to cause the range sensor 12 to determine the range. Alternatively, the range sensor 12 may dynamically determine the range for all aligned objects such that the user is not required to function the inputs 32 to determine the range. Similarly, the tilt sensor 14 may dynamically determine the angle for all aligned objects or the tilt sensor may determine the angle when the user functions at least one of the inputs 32. Thus, the ranges, angle, and ballistic information discussed below may be dynamically displayed to the user.

In various embodiments, the device 10 enables the user to provide configuration information to facilitate determination of ballistic information, including hold-over information, by the computing element 16. The configuration information includes mode information to enable the user to select between various projectile modes and to input the actual sight-in distance for a particular firearm to be used. Further, the configuration information may include projectile information, such as a bullet size, caliber, grain, shape, type, etc and firearm caliber, size, type, etc.

Figure 7:
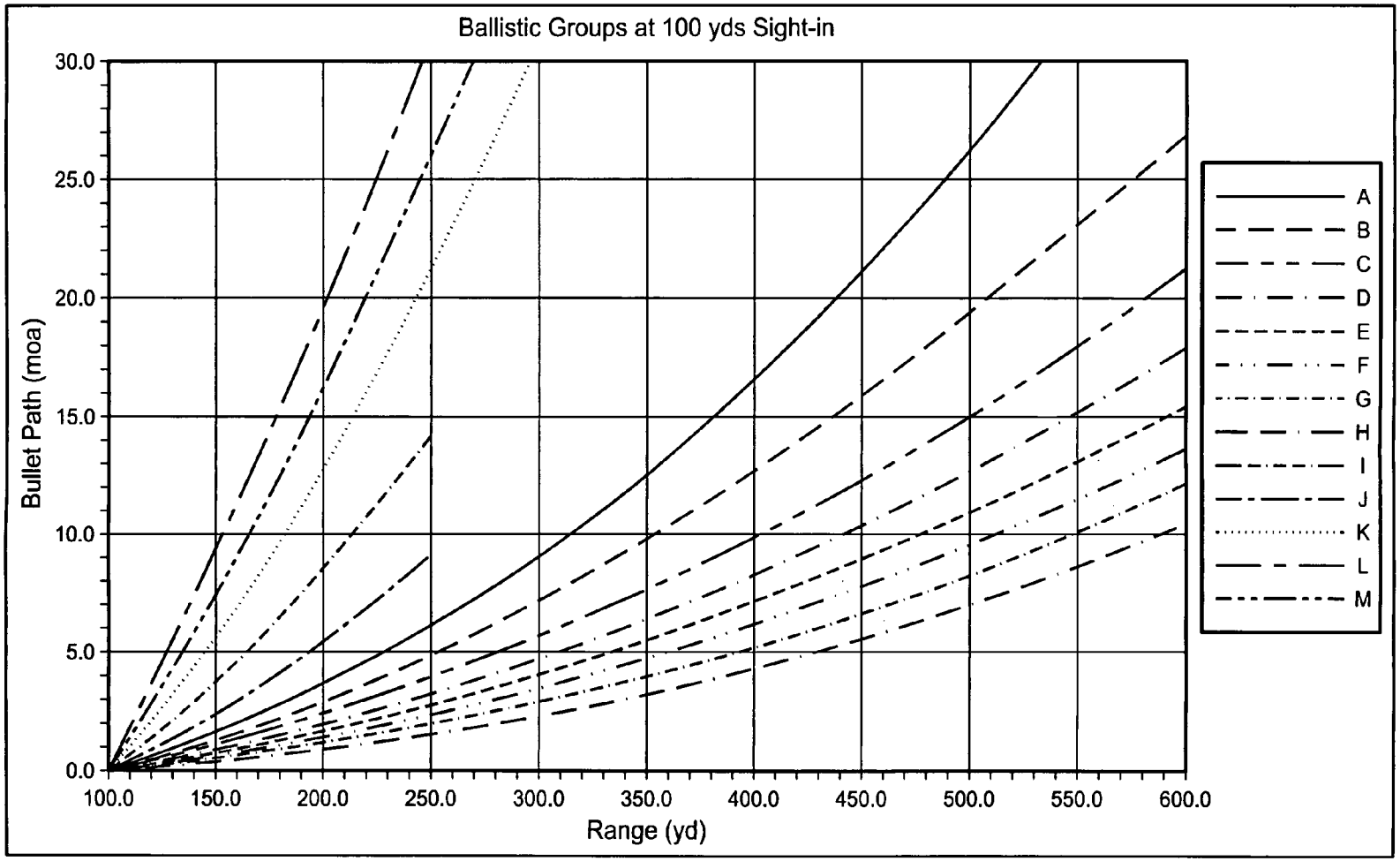
FIG. 7 is a chart illustrating a plurality of ballistic curves.

Preferably, the provided configuration information corresponds to one of a plurality of ballistic curves. For example, the user may select one curve, or provide an indication relating to one curve, instead of entering detailed and complex ballistic information such as bullet shape, grain, caliber, etc. As shown in FIG. 7, five sample curves, denoted with letters A-M, are provided each corresponding to a particular ballistic profile. For instance, J may correspond to a pistol profile, E may correspond to a small-caliber rifle profile, F may correspond to a rifle profile, H may correspond to a medium-power rifle profile, G may correspond to a high-power rifle profile, etc. As should be appreciated, innumerable combinations of ballistic curves may exist each corresponding to any ballistic profile. Various ballistic curves are disclosed in U.S. Pat. No. 3,990,155, which is incorporated herein by reference.

The user may provide the configuration information to the device 10 by functioning the inputs 32. For example, the user may depress one or more of the inputs 32 to provide configuration information and/or the user may provide electronic data utilizing the inputs 32 through a data connection, etc. Additionally, the display 30 may present prompts, indication elements, menus, selectable lists, etc, to help the user in providing the configuration information.

Further, the memory 18 may include information corresponding to configuration information to enable the user-provided configuration information to be stored by the memory 18. Also, the memory 18 may store databases of configuration information, such as the plurality of ballistic curves or data corresponding to the ballistic curves, to enable the user to select configuration information from the data stored by the memory 18. For example, the display 30 may provide a listing of stored configuration information for selection by the user.

In embodiments where the memory 18 comprises non-volatile memory, the configuration information may be permanently stored by the user such that the user need not repeatedly provide the information each time the device 10 is used. However, due to the ease in which one of the plurality of ballistic curves may be selected, utilization of non-volatile memory is not necessary in all embodiments.

The device 10 is further operable to determine ballistic information including a hold-over value corresponding to an amount of hold-over. As is known in the art, hold-over refers to the amount by which the user must aim high, or above the target, to compensate for the effects of trajectory, projectile drop, and angle. Thus, the hold-over value determined by the device 10 provides an indication of how much, or to what degree, the user must aim high in relation to the target to accurately fire a projectile.

FIG. 6 illustrates two exemplary projectile trajectories. In this example, the projectiles are bullets shot from a firearm. For both a positive angle and a zero angle of the firearm, the following is illustrated: a parabolic (ballistic) bullet trajectory, a line of departure (LOD), which is the axis of the barrel of the firearm, and a line of sight (LOS), which is the axis of the sight or scope. Corresponding bullet paths (BP) and bullet drops (BD) are also illustrated. In this example, a bullet path (BP) is the perpendicular distance between the line of sight (LOS) and the parabolic bullet trajectory at a particular range. Bullet drop (BD) is the vertical distance between the line of departure (LOD) and the parabolic bullet trajectory at a particular range. In this example, R0 represents the sight-in distance of the firearm. If the target is greater than the distance of the firearm (eg., R1 in this example), the bullet will strike at a point below the point of aim due to gravity. Therefore, bullet path (BP) or angle $\alpha$ correspond to the amount of hold-over needed for the firearm at a particular range.

As is known in the art and as shown in FIG. 6, firing a projectile at uphill (or downhill) angles affects the trajectory of the projectile by causing the projectile to impact high relative to the projectile path for level fire. Therefore, the hold over amount, for angled fire, must be reduced to prevent the shooter from shooting too high. Specifically, the angle $\theta$ between the zero-angle line of sight and any non-zero angle of the riflescope or sight can be used to angle-correct stored hold-over values, as described below.

Additionally, as will be appreciated by those skilled in the art, the amount of hold-over is dependent on the range at which a firearm is sighted in. For instance, firearms are typically sighted in at 100 yards, such that a user need not hold-over when firing at targets at 100 yards, but would need to hold-over for targets substantially over 100 yards. The device 10 preferably utilizes a default sight in distance of 100 yards, which may be stored in the memory 18. However, the device 10 may utilize a user-provided sight-in distance, as discussed herein, to determine the hold-over value.

The device 10 may determine a corrected hold-over value utilizing various methods. Preferably, the computing element 16 determines the corrected hold-over value utilizing the range and the determined angle by acquiring a hold-over value corresponding to the range and modifying the hold-over value utilizing the determined angle. The hold-over values stored in memory 18 may correspond to the amount of vertical projectile drop from the line of sight (bullet path BP in FIG. 6) at a particular range and at zero angle.

The computing element 16 may acquire the hold-over value from the memory 18. For instance, as described above, the memory 18 may store the database of ballistic information, including a listing, table, chart, etc, of hold-over values corresponding to various ranges and configuration information. For instance, the database may include data corresponding to the chart of FIG. 7 to enable the retrieval of a hold-over value, in minutes of angle (MOA), inches, yards, centimeters, reticle positions, etc, based upon the range.

Preferably, the projectile hold-over value is retrieved utilizing both the range and the configuration information. For instance, as is shown in FIG. 7, the bullet path (BP) value may be dependent upon the particular projectile or firearm utilized, such that retrieving a hold-over value corresponding to a utilized projectile facilitates accurate shooting. Thus, in embodiments where the user selects one of the plurality of ballistic curves, the hold-over value is preferably retrieved utilizing the selected ballistic curve and the range.

The computing element 16 may also or additionally acquire the hold-over value utilizing a look-up table or other database element. For example, the database may include an ordered listing, table, and/or relational listing of ranges, configuration information, and hold-over values, such that the hold-over value may be acquired by providing the range and configuration information, such as projectile curve, type, size, etc. Such data corresponding to hold-over values, ranges, and other ballistic information is commonly available through numerous sources such as bullet manufacturers, firearm manufacturers, internet databases, textbooks, etc, and may be stored within the memory 18 for retrieval by the computing element 16 and/or to help the user in providing configuration information.

Further, as will be appreciated by those skilled in the art, the hold-over value may be dependent on the range at which the firearm is sighted-in. For instance, the chart of FIG. 7 indicates a hold-over value of zero at 100 yards as a firearm sighted-in at 100 yards and thus on a level surface would experience no additional drop for which compensation is required by the user.

The computing element 16 may utilize a default sight-in distance of 100 yards and retrieve hold-over values accordingly and/or the computing element 16 may utilize an actual sight-in distance and retrieve hold-over values accordingly or modify a retrieved hold-over value utilizing algorithms to reflect variations in sight-in distance.

Specifically, during development of this invention, it has been unexpectedly discovered that the change in the bullet path or amount of vertical projectile drop from the line of sight at zero angle from a range of 100 yards to 1,000 yards is substantially independent of the sight-in distance. As you will recall, the hold-over value corresponds to the amount of vertical projectile drop from the line of sight (referred to as bullet path herein) at a particular range and at zero angle.

Referring to Table 1 below, the bullet path for the same load was determined for a 100 yard sight-in distance, a 200 yard sight-in distance, and a 300 yard sight-in distance (all level shooting for purposes of this example). In this example, the amount of change in bullet path from a 100 yard range to a 1,000 yard range equals about 43.8 moa, regardless of the sight-in range.

Figure 9:
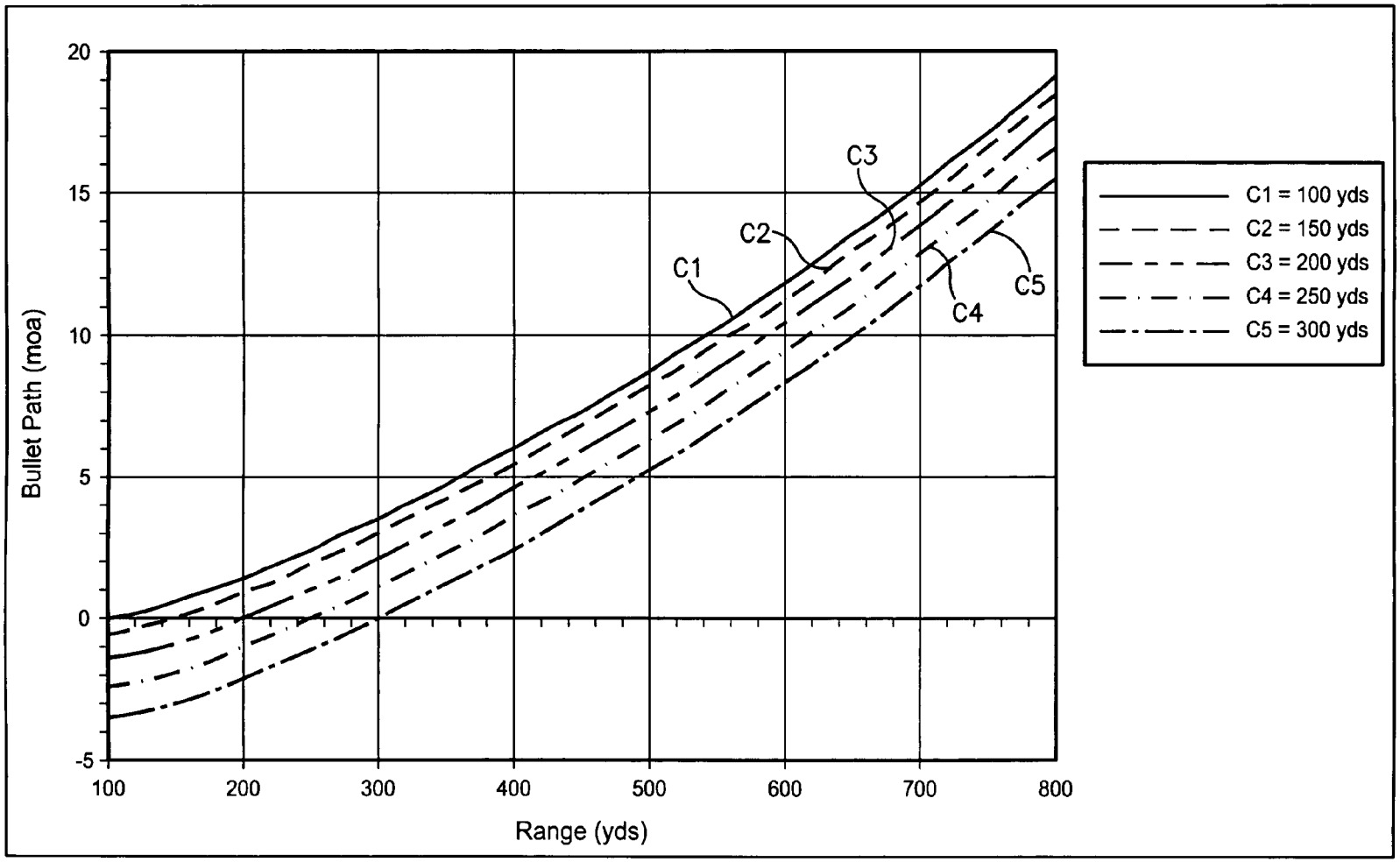
FIG. 9 is a graph illustrating bullet path values at a plurality of ranges for a plurality of sight-in distances.

For instance, note that for a sight-in range of 300, the bullet path was −38.7 moa for the 1,000 yard range and 5.1 moa for the 100 yard range. The negative number indicates hold-over and the positive number indicates hold-under. The difference between these values is 43.8 moa. When plotting bullet path values for various sight-in ranges, as illustrated in FIG. 9, relatively identical curves are obtained, crossing the x-axis at different locations.

TABLE 1

| Range (Yards) | Sight-in: 100 yds Bullet Path (moa) | Sight-in: 200 yds Bullet Path (moa) | Sight-in: 300 yds Bullet Path (moa) |
|---|---|---|---|
| 100 | 0 | 2.1 | 5.1 |
| 150 | −0.9 | 1.2 | 4.2 |
| 200 | −2.1 | 0 | 2.9 |
| 250 | −3.5 | −1.4 | 1.5 |
| 300 | −5.1 | −2.9 | 0 |
| 350 | −6.7 | −4.6 | −1.7 |
| 400 | −8.5 | −6.4 | −3.4 |
| 450 | −10.4 | −8.3 | −5.4 |
| 500 | −12.5 | −10.4 | −7.4 |
| 550 | −14.7 | −12.6 | −9.6 |
| 600 | −17.1 | −14.9 | −12 |
| 650 | −19.6 | −17.5 | −14.6 |
| 700 | −22.4 | −20.2 | −17.3 |
| 750 | −25.3 | −23.2 | −20.3 |
| 800 | −28.5 | −26.4 | −23.4 |
| 850 | −31.9 | −29.8 | −26.9 |
| 900 | −35.6 | −33.5 | −30.5 |
| 950 | −39.6 | −37.4 | −34.5 |
| 1000 | −43.8 | −41.6 | −38.7 |

To take advantage of this relationship between the hold-over values (or bullet path) for different sight-in values, the following equation may be used by the computing element 16 to determine an adjusted hold-over value for a variety of actual sight-in distances:

$$Y_{adjusted} = Y(x) - Y(S)$$

Where:

S=actual sight-in distance x=range

Y=hold-over value or bullet path value

The user may provide the actual sight-in distance, such as 300 yards, to the computing element 16 via the input 32. So, for example, if only the hold-over values for a 100 yard default sight-in distance for a particular load are stored in memory 18, but a user has a firearm sighted-in at 300 yards, and the user wants to determine the hold-over value at 600 yards, the equation above is used as follows. The hold-over value stored in memory 18 at 600 yards is −17.1 moa, which in this case is the Y (x) value. The hold-over value stored in memory for 300 yards is −5.1 moa, which in this case is the Y(S) value. So, $Y_{adjusted}$ equals −17.1 minus −5.1, which equals −12 moa. As shown in Table 1, for the sight-in distance of 300 yards, the hold-over value at a range of 600 yards is indeed −12 moa. Therefore the computing element 16 may calculate the hold-over value for a plurality of actual sight-in distances based on stored hold-over values for various loads at a default sight-in distance of 100 yards. However, other default sight-in distances may be used.

To compensate for angled projectile trajectories in determining the hold-over value, the computing element 16 is operable to utilize the angle determined by the tilt sensor 14 to modify the acquired hold-over value. As explained above and shown in FIG. 6, the bullet path or projectile drop from the line of sight (and therefore the hold-over value) varies according to angle. The amount of variance may be expressed utilizing a cosine of the acquired angle.

Specifically, an angle-corrected hold-over value may be determined by the computing element 16 by multiplying the hold-over value corresponding to the range or the adjusted hold-over value described above by the cosine of the acquired angle. The hold-over value corresponding to the range, the adjusted hold-over value, configuration information, and other data may be provided and/or displayed utilizing various units. For example, the hold-over value and bullet path (or vertical projectile drop from the line of sight) may correspond to minutes of angle, inches, centimeters, reticle positions, combinations thereof, etc. As shown in FIG. 8, the hold-over value may be displayed by the display 30 as both a numerical value in inches, 24 inches for example, or as one or more reticles, such as a first reticle and a second reticle.

For instance, the first reticle may be a fixed reticle that corresponds to the sight-in distance while the second reticle may be a dynamically-displayed reticle that reflects changes to the first reticle based upon the determined hold-over value. The hold-over value may also refer to one or more reticles on the user's riflescope, such as the number of dots on the a reticle that the user must aim high.

U.S. Patent Application Publication Nos. 2007/0137091 and 2006/0010760, as well as U.S. Pat. No. 7,239,377, disclose optical devices having laser range sensors and inclinometers, and are incorporated herein by reference in their entirety.

Although the invention has been described with reference to the preferred embodiments illustrated in the attached drawings, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A rangefinder device for determining a hold-over value at a particular range for a particular sight-in distance, the device comprising:

a range sensor configured for determining a range to a target;

a memory element storing a database of ranges and corresponding hold-over values for a default sight-in distance; and a computing element, coupled with the range sensor and the memory, configured for receiving an actual sight-in distance and the range to the target and for determining an adjusted hold-over value for the range to the target by comparing a first hold-over value from the database corresponding with the range to the target to a second hold-over value from the database corresponding with a range equal to the actual sight-in distance, wherein the computing element is configured to determine the adjusted hold-over value by subtracting the second hold-over value from the first hold-over value.

2. The rangefinder device of claim 1, further comprising an input coupled with the computing element and configured for providing the actual sight-in distance to the computing element.

3. The rangefinder device of claim 1, wherein the default sight-in distance is 100 yards.

4. The rangefinder device of claim 1, wherein the target is substantially level with the rangefinder.

5. The rangefinder device of claim 1, further comprising a tilt sensor for determining an angle to the target relative to the device, wherein the computing element determines an angle-adjusted hold-over value based on the adjusted hold-over value further modified utilizing the determined angle.

6. The rangefinder of claim 1, further comprising a display configured for indicating the range and the adjusted hold-over value.

7. The rangefinder of claim 1, wherein the range sensor includes a laser range sensor.

8. The rangefinder of claim 5, wherein the tilt sensor includes an inclinometer.

9. The rangefinder of claim 1, further comprising a portable handheld housing configured to house the range sensor, memory element, and computing element.

10. A rangefinder device for determining hold-over ballistic information, the device comprising:

a laser range sensor configured for determining a range to a target;

a memory element storing a database of ranges and corresponding hold-over values for a default sight-in distance; and a computing element, coupled with the range sensor and the memory, and configured for:

receiving an actual sight-in distance and the range to the target, and determining an adjusted hold-over value for the range to the target by accessing a first hold-over value from the database corresponding with the range to the target, accessing a second hold-over value from the database corresponding with a range equal to the actual sight-in distance, and subtracting the second hold-over value from the first hold-over value.

11. The rangefinder device of claim 10, further comprising an input coupled with the computing element and configured for providing the actual sight-in distance to the computing element.

12. The rangefinder device of claim 10, wherein the default sight-in distance is 100 yards.

13. The rangefinder device of claim 10, wherein the target is substantially level with the rangefinder.

14. The rangefinder device of claim 10, further comprising a tilt sensor coupled with the computing device for determining an angle to the target relative to the device, wherein the computing element further adjusts the hold-over value based on the adjusted hold-over value at the range and the determined angle.

15. The rangefinder of claim 1, wherein the range sensor includes a laser range sensor.

16. The rangefinder of claim 14, wherein the tilt sensor includes an inclinometer.

17. The rangefinder of claim 14, further comprising a portable handheld housing configured to house the range sensor, memory element, tilt sensor, and computing element.

18. The rangefinder of claim 10, further comprising a display configured for indicating at least one of the adjusted hold-over value and the range to the target.

19. A rangefinder device for determining hold-over ballistic information, the device comprising:

a laser range sensor configured for determining a range to a target;

a tilt configured sensor for determining an angle to the target relative to the rangefinder device;

a memory element storing a database of ranges and corresponding hold-over values for a default sight-in distance;

an input configured for providing an actual sight-in distance;

a computing element, coupled with the range sensor, the tilt sensor, the input, and the memory, and configured for:

receiving an actual sight-in distance, the angle, and the range to the target, and determining an adjusted hold-over value for the range to the target by accessing a first hold-over value from the database corresponding with the range to the target, accessing a second hold-over value from the database corresponding with a range equal to the actual sight-in distance, and subtracting the second hold-over value from the first hold-over value; and a display for indicating the range and the adjusted hold-over value.

20. A method for determining hold-over ballistic information, the method comprising:

obtaining a range to a target;

obtaining an actual sight-in distance;

accessing a database of ranges and corresponding hold-over values for a default sight-in distance;

obtaining a first hold-over value from the database corresponding with the range to the target;

obtaining a second hold-over value from the database corresponding with a range equal to the actual sight-in distance; and subtracting the second hold-over value from the first hold-over value to obtain an adjusted hold-over value.

21. The method of claim 20, further comprising:

determining an angle to the target relative to a shooting implement; and calculating an angle-adjusted hold-over value based on the adjusted hold-over value and the angle.

22. The method of claim 20, further comprising displaying the range and the adjusted hold-over value on a display.

* * * * *